US005911227A

United States Patent [19]

Shweky

[11] Patent Number: 5,911,227

[45] Date of Patent: Jun. 15, 1999

[54] COMBINATION HAIR ACCESSORY AND TOY

[75] Inventor: Steven Shweky, Brooklyn, N.Y.

[73] Assignee: Designs By Skaffles, Inc., New York, N.Y.

[21] Appl. No.: 09/094,647

[22] Filed: Jun. 15, 1998

[51] Int. Cl.[6] ..... A45D 8/00

[52] U.S. Cl. ..... 132/275; 446/369; 446/27

[58] Field of Search ..... 132/246, 247, 132/273, 275, 55, 278; 446/268, 270, 297, 369, 227, 901, 26, 27, 302, 419, 296; 63/1.12, 1.18, 1.11; 472/133; 2/209.13; D28/41

[56] References Cited

U.S. PATENT DOCUMENTS

| | | | |
|---|---|---|---|
| D. 131,600 | 5/1942 | Holden . | |
| D. 158,103 | 9/1950 | Kuenstner . | |
| D. 167,553 | 5/1952 | Behr . | |
| D. 221,115 | 7/1971 | Solomon . | |
| D. 292,030 | 9/1987 | Revson . | |
| D. 315,226 | 3/1991 | Revson . | |
| D. 356,393 | 3/1995 | Revson . | |
| D. 356,887 | 4/1995 | Revson et al. . | |
| D. 373,850 | 9/1996 | Revson . | |
| 537,542 | 4/1895 | Moore . | |
| 971,519 | 10/1910 | Brannen . | |
| 1,720,038 | 7/1929 | Feldstein | 446/297 |
| 2,668,547 | 2/1954 | Wille . | |
| 2,805,673 | 5/1957 | Solomon . | |
| 2,945,500 | 1/1960 | Bolinger . | |
| 3,099,271 | 7/1963 | Dubelier . | |
| 3,301,266 | 1/1967 | Hoffmann . | |
| 3,842,849 | 10/1974 | Goodman | 132/273 |
| 4,563,159 | 1/1986 | Hill et al. | 446/369 |
| 4,936,699 | 6/1990 | Yoshida | 446/26 |
| 5,097,854 | 3/1992 | Smith . | |
| 5,156,171 | 10/1992 | Goodman | 132/273 |
| 5,301,696 | 4/1994 | Revson | 132/275 |
| 5,388,598 | 2/1995 | Whitten . | |
| 5,413,126 | 5/1995 | Revson . | |
| 5,472,003 | 12/1995 | Frame et al. . | |
| 5,489,231 | 2/1996 | Leyser | 446/369 |
| 5,504,943 | 4/1996 | Han . | |
| 5,526,830 | 6/1996 | Hunter | 132/273 |
| 5,561,864 | 10/1996 | DeMars | 446/27 |
| 5,626,503 | 5/1997 | Heftel et al. | 132/275 |
| 5,694,955 | 12/1997 | Grooms . | |

*Primary Examiner*—Todd E. Manahan
*Assistant Examiner*—Eduardo C. Robert
*Attorney, Agent, or Firm*—Michael R. Gilman; Kaplan & Gilman LLP

[57] ABSTRACT

An improved hair accessory and toy combination is provided. The combination hair accessory and toy comprises a hair accessory having a selectively stretchable member within a decorative fabric cover and an opening extending through the center of the stretchable member and decorative fabric cover. The combination hair accessory and toy further comprises a toy element attached, and/or selectively removably attached, to an outside surface of the fabric, wherein the toy is interactive with the wearer of the hair accessory or a non-wearer companion of the wearer.

4 Claims, 3 Drawing Sheets

COMBINATION HAIR ACCESSORY AND TOY

BACKGROUND OF THE INVENTION

This invention relates to the hair accessory and toy fields, and more particularly, to a combination hair accessory and toy.

Both hair accessories and toys are old in the art. Hair accessories come in many shapes, sizes, constructions and manners of operation. In particular, there are hair combs which keep one's hair in place through the teeth elements of a comb, there are hair clips and barrettes which keep a person's hair in place by having two arm sections which have located there between some of the person's hair and which then clip together to secure those elements of the hair in a certain location, and many and varied other types of hair accessories, including what has come to be known as the scrunchy.

A scrunchy is essentially a rubberband element covered with some type of fabric, whether it be natural of synthetic fiber, wherein when the rubberband is in its at rest position, the fabric is bunched up around the rubberband in a decorative manner. The way these scrunchy hair accessories hold a person's hair is through the center opening, with the scrunchy essentially being used as women have for many years as a regular rubberband. In particular, a certain amount of hair is pulled through the center of the scrunchy, "rubberband", a twist is made securing that diameter of hair within a smaller diameter of the twisted rubberband. The hair is then pulled once again through the bigger opening and the rubberband is once again twisted, creating another bigger opening. This process is repeated a number of different times until the hair is securely located within the rubberband creating a ponytail and/or a pigtail type of look.

The scrunchy was created to simply add a decorative fabric covering to the rubberband to further enhance the look of the person's hair, so that now the person, when seen by another person, doesn't simply have a brown rubberband in their hair, but some nice colored fabric adorning their hair.

It is also very old in the art that toys exist for people, especially young children, to play with. It is also old in the art to make these toys interactive with the user. Such manners of interaction have in the past included what has been named a beanbag, where beans or other types of substantially spherically-shaped balls are located within a fabric container and the container is malleable in the person's hand. Beanbags do not necessarily have beans inside, but any type of substantially spherical plurality of balls which move with relation to each other when manipulated by the hand of a user.

Interactive toys have also most recently consisted of toys which when one element of the toy is pressed, speak to the person playing with the toy. Usually, the speech associated with these types of toys is non-interactional, and merely consists of pre-recorded statements or songs.

To the extent known by the inventor, there has never been a hair accessory which combines the functioning of the hair accessory with the interactive playfulness of a toy. Accordingly, it would be desirable to provide a combination hair accessory and toy which ornamentally holds a person's hair in certain desired positions while at the same time being an interactive toy that can be played with by the user, or a non-user companion of the user, while the hair accessory is in place on the user's head.

SUMMARY OF THE INVENTION

In accordance with the invention, an improved hair accessory and toy combination is provided. The combination hair accessory and toy comprises a hair accessory having a selectively stretchable member within a decorative fabric cover and an opening extending through the center of the stretchable member and decorative fabric cover, and further comprising a toy element attached, and/or selectively removably attached, to an outside surface of the fabric, wherein the toy is interactive with the wearer of the hair accessory or a non-wearer companion of the wearer.

Accordingly, it is an object of the invention to provide a combination hair accessory and toy.

Still another object of the invention is to provide a combination hair accessory and toy which is both ornamental when worn on a wearer's head, and interactive with the wearer or a non-wearer companion.

Other objects of the invention will in part be obvious and will in part be apparent from the following description.

The invention accordingly comprises assemblies possessing the features, properties and the relation of components which will be exemplified in the products hereinafter described, and the scope of the invention will be indicated in the claims.

BRIEF DESCRIPTION OF THE DRAWINGS

For a fuller understanding of the invention, reference is made to the following description taken in connection with the accompanying drawings, in which.

DETAILED DESCRIPTION OF THE PREFERRED EMBODIMENTS

Figure 1:
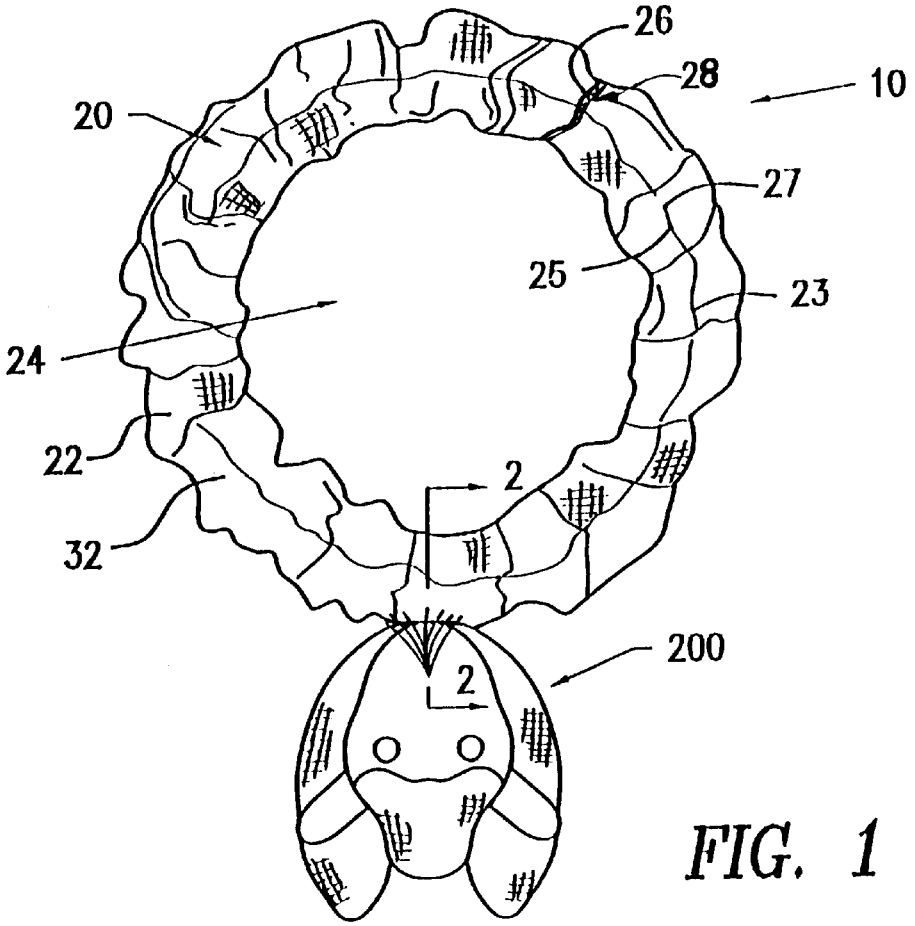
FIG. 1 is a top plan view of a combination hair accessory and toy made in accordance with the invention.

Referring first to FIG. 1, a combination hair accessory and toy is shown at 10. Hair accessory and toy combination 10 has a hair accessory 20 and a toy 200.

Figure 2:
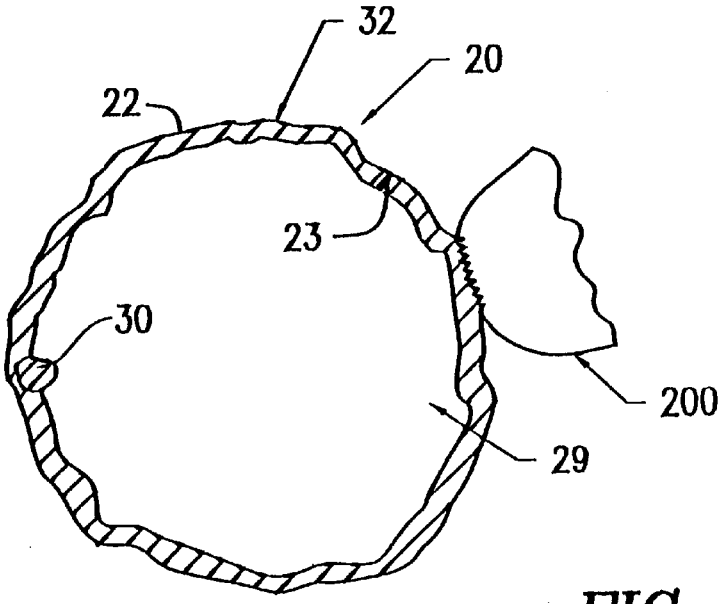
FIG. 2 is a cross-sectional view taken along line 2—2.

Discussing first hair accessory 20, hair accessory 20 has a fabric member 22 and an opening 24 extending through the center thereof As is shown in FIG. 2, within fabric 22 of hair accessory 20 is a selectively stretchable member 30. In the preferred embodiment, stretchable member 30 is a standard rubberband, able to have any normally found construction in the field. Member 30 can also be any other type of selectively stretchable product which has a memory function of returning to a "pre-stretched at-rest position"after it has been stretched. Member 30 is not necessarily attached to fabric 22 of accessory 20, and therefore, fabric 22 is allowed to move in any relation to member 30. This creates many different looks and twists to accessory 20. It is also anticipated by the invention that member 30 is attached to fabric 22.

As is also seen in FIG. 1, fabric 22 has first end surface 26 and second end surface 28, which are connected to create the substantially annular look to accessory 20. As is seen in FIGS. 1 and 2, the length of the fabric 22 making up accessory 20 is substantially defined by stitch-line 23.

Stitch-line 23 is the connection line between first and second edges 25 and 27 of fabric 22.

Essentially, fabric 22 starts off as a rectangularly-shaped piece of fabric material having its length defined by edges 25 and 27, and its width defined by ends 26 and 28 (not shown). In constructing accessory 20, stitch-line 23 connecting edges 25 and 27 is made while stretchable member 30 is on, and thereafter within, fabric 22. Once stretchable member 30 is sealed within fabric 22 and stitch-line 23 is complete, ends 26 and 28 of fabric 22 are themselves stitched together, thereby fully closing stretchable member 30 within the open space of accessory 20, as that open space is seen in FIG. 2 at 29.

As is further seen in FIG. 1, a toy 200 is attached at long an outer surface 32 of accessory 20. In its preferred embodiment, toy 200 is attached to surface 32 through means of standard stitching practices used to attach one fabric to another. However, it is anticipated by the invention that instead of fixedly attaching toy 200 to accessory 20, standard hook and loop fabric (not shown) could be used to allow selective removability of toy 200 from accessory 20. In particular, either the hook or loop fabric member of the hook and loop fabric would be attached to outside surface 32 of accessory 20, while the counterpart hook or loop fabric element would be attached at some point along with body of toy 200. In this manner, toy 200 would be selectively removable from accessory 20 by the wearer or a non-wearer companion.

Figure 3:
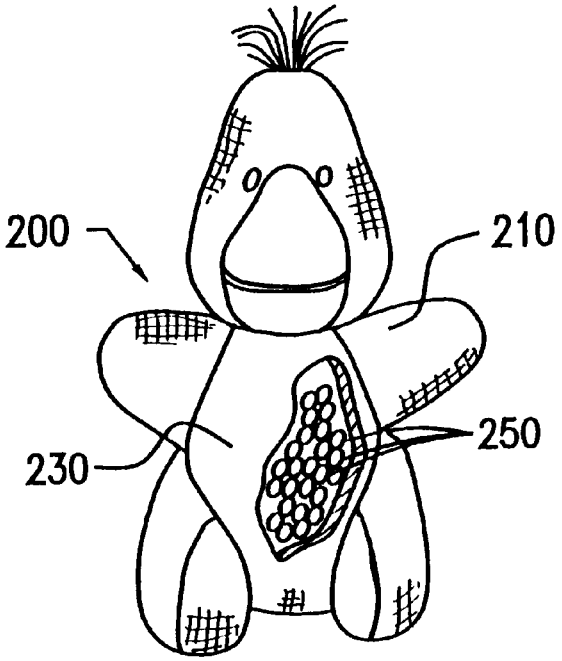
FIG. 3 is a front elevational view of the toy element of the subject invention showing in cut-out a portion of the internal interactive element.

Further discussing FIGS. 1 and 2, it is seen that toy 200 is attached to accessory 20 along a back portion of toy 200. In essence, wherever toy 200 is attached to accessory 20, will be considered the non-interactive side of toy 200, while some other portion of toy 200 will be considered the interactive side. For example, and as shown in FIG. 3, toy 200 has a beanbag-type construction so that within main body portion 210 of toy 200, there are a plurality of substantially spherically-shaped balls 250 which are selectively movable with respect to each other and by movement of the user (wearer) or non-user (wearer) companion. While toy 200 is attached to hair accessory 20, the interactive side of toy 200 is the front side 230 (see FIG. 3).

Figure 4:
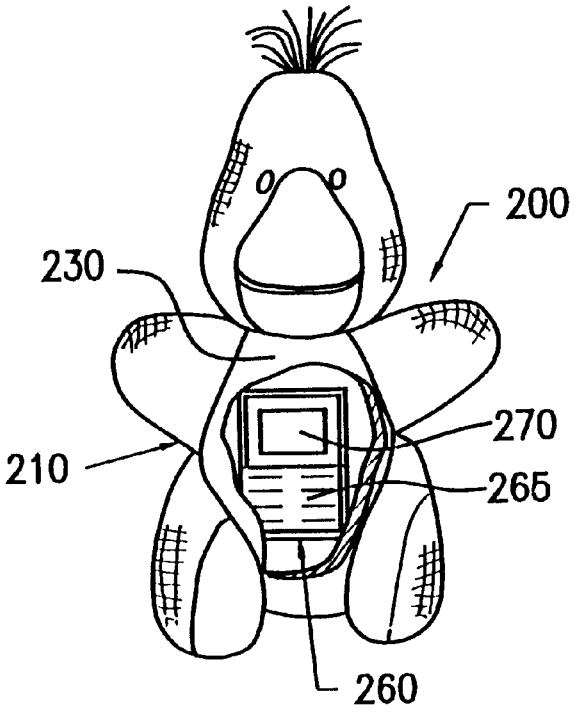
FIG. 4 is a front elevational view of the toy element of the subject invention showing in cut-out a portion of the internal interactive element.
Figure 5:
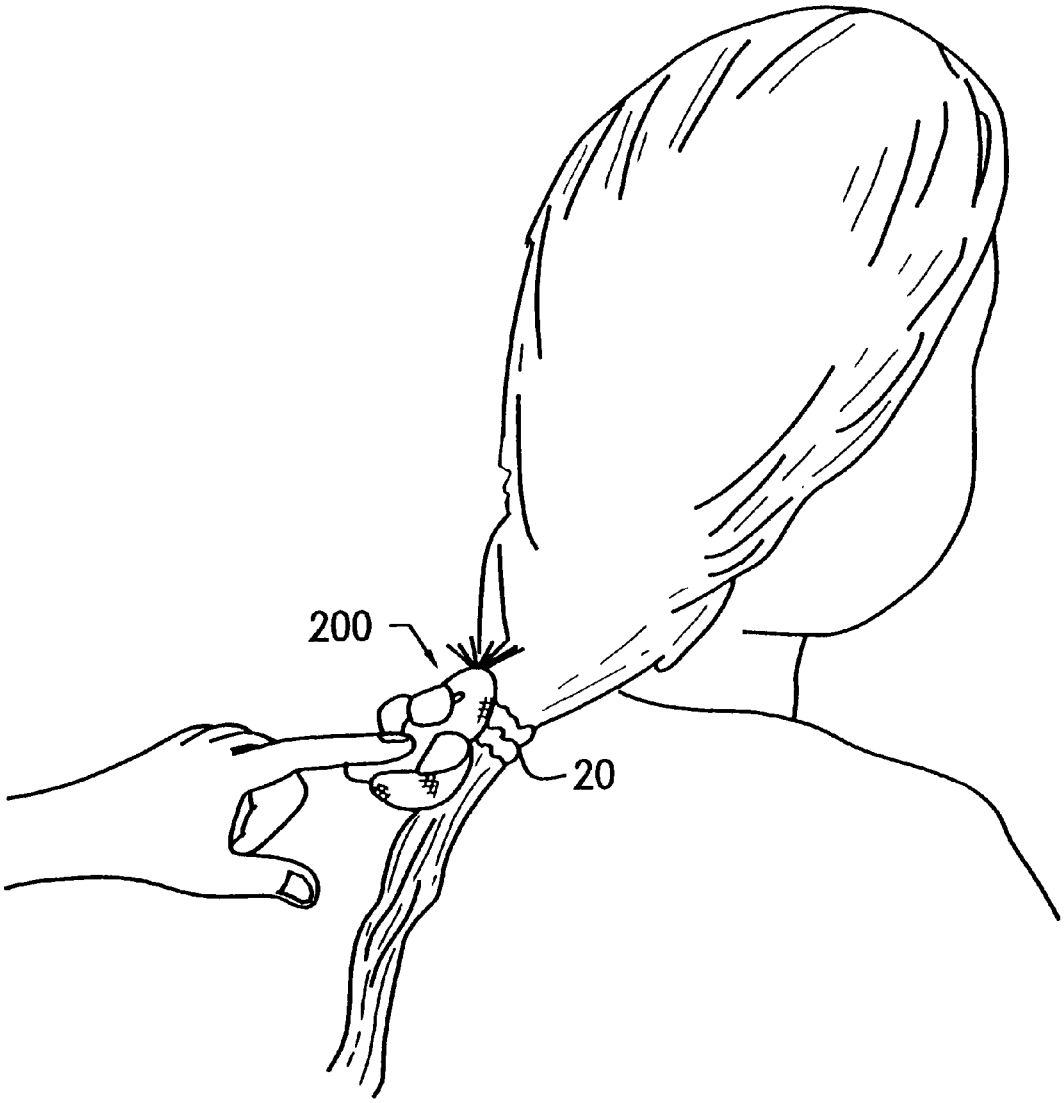
FIG. 5 is a prospective view of the combination hair accessory and toy of the invention shown worn on a wearer's head with a non-wearer companion also interacting with the toy.

Similarly, turning to FIG. 4, it is seen that the interactive nature of toy 200 is from a different interactive construction. In FIG. 4 the interaction takes place due to a pressure-activated talk-box 260. Talk-box 260 has a speaker 265 and a pressure-sensitive start button 270.

It is anticipated by the invention that any talk-box 260 known in the art is usable in toy 200, as long as by pressing upon it at some point the associated talking or musical sound is played. Additionally, the invention anticipates the use of any types of elements 250; whether they would be beanbags, small marbles, grains of sand or actual beans or other types of substantially spherically-shaped balls.

The invention also anticipates that toy 200 can be any type of toy. The preferred embodiment is a plush toy animal or doll or human figure, which can take on any shape. The invention is shown with a duck toy 200 attached to accessory 20. When pressed in accordance with FIG. 4, toy 200 (having the duck shape) would make, for example, a quacking sound.

It will thus be seen that the objects set forth above among those made apparent from the proceeding description, are efficiently attained, and since certain changes may be made in the above constructions without departing from the sphere and scope of the invention, it is intended that all matter contained in the above description and shown in the accompanying drawings shall be interpreted as illustrative, and not in a limiting sense.

It is also to be understood that the following claims are intended to cover all of the generic and specific features of the invention herein described and all statements of the scope of the invention, which, as a matter of language, might be said to fall therebetween.

What is claimed is:

1. A combination hair accessory and toy, comprising:

a hair accessory, comprising:

a selectively stretchable member having an inside surface defining an opening therethrough;

a decorative cover member placed around said selectively stretchable member, said cover comprising:

a fabric member;

a first edge and a second edge, said edges defining a length of said fabric; and first and second end surfaces located at opposite sides of said length of said fabric and between said first and second edges;

wherein said first and second edges are substantially secured together around said selectively stretchable member, and said first and second ends are substantially secured together so that said selectively stretchable member is located within said cover;

wherein said selectively stretchable member Surrounded by said fabric defines an inside surface of said fabric and a second opening therethrough; and a toy element attached to an outside surface of said fabric at a point along said outside surface of said fabric, said toy element comprising a main body portion comprising an interactive element associated therewith, said interactive element comprising a plurality of selectively movable members located within said body portion of said toy element;

wherein said toy is interactive with a wearer of said hair accessory and toy combination or a non-wearer companion of said wearer of said hair accessory and toy combination.

2. A hair accessory and toy combination as recited in claim 1, said plurality of selectively movable members comprising a plurality of substantially spherically-shaped elements.

3. A combination hair accessory and toy, comprising:

a hair accessory, comprising:

a selectively stretchable member having an inside surface defining an opening therethrough;

a decorative cover member placed around said selectively stretchable member, said cover comprising:

a fabric member;

a first edge and a second edge, said edges defining a length of said fabric; and first and second end surfaces located at opposite sides of said length of said fabric and between said first and second edges;

wherein said first and second edges are substantially secured together around said selectively stretchable member, and said first and second ends are substantially secured together so that said selectively stretchable member is located within said cover;

wherein said selectively stretchable member surrounded by said fabric defines an inside surface of said fabric and a second opening therethrough; and a toy element selectively removably attached to an outside surface of said fabric at a point along said outside surface of said fabric, said toy element comprising a main body portion comprising an interactive element associated therewith, wherein said interactive element is a plurality of selectively movable members located within said body portion of said toy element;

wherein said toy is interactive with a wearer of said hair accessory and toy combination or a non-wearer companion of said wearer of said hair accessory and toy combination.

4. A hair accessory and toy combination as recited in claim 3 said plurality of selectively movable members comprising a plurality of substantially spherically-shaped elements.

* * * * *